US009683303B2

(12) United States Patent
Aliprandini et al.

(10) Patent No.: US 9,683,303 B2
(45) Date of Patent: Jun. 20, 2017

(54) METHOD OF OBTAINING A YELLOW GOLD ALLOY DEPOSITION BY GALVANOPLASTY WITHOUT USING TOXIC METALS OR METALLOIDS

(71) Applicants: The Swatch Group Research and Development Ltd, Marin (CH); Giuseppe Aliprandini, Anieres (CH)

(72) Inventors: Giuseppe Aliprandini, Anieres (CH); Michel Caillaud, Villers-le-Lac (FR)

(73) Assignees: The Swatch Group Research and Development Ltd, Marin (CH); G. Aliprandini, Anieres (CH)

( * ) Notice: Subject to any disclaimer, the term of this patent is extended or adjusted under 35 U.S.C. 154(b) by 6 days.

(21) Appl. No.: 14/244,071

(22) Filed: Apr. 3, 2014

(65) Prior Publication Data

US 2014/0299481 A1 Oct. 9, 2014

Related U.S. Application Data

(62) Division of application No. 12/678,984, filed as application No. PCT/EP2008/062042 on Sep. 11, 2008.

(30) Foreign Application Priority Data

Sep. 21, 2007 (CH) ..... 1494/07

(51) Int. Cl.

| | |
|---|---|
| ***C23C 18/00*** | (2006.01) |
| ***C25D 3/58*** | (2006.01) |
| ***C25D 3/62*** | (2006.01) |
| *C25D 3/48* | (2006.01) |

(52) U.S. Cl.
CPC *C25D 3/62* (2013.01); *C25D 3/48* (2013.01)

(58) Field of Classification Search
CPC ..... C23C 18/16; C23C 18/48; C25D 3/40; C25D 3/56; C25D 3/58; C25D 3/62
USPC .... 106/1.18, 1.19, 1.23, 1.26; 205/242, 247, 205/249, 251
See application file for complete search history.

(56) References Cited

U.S. PATENT DOCUMENTS

| | | | | | |
|---|---|---|---|---|---|
| 2,596,454 | A | | 5/1952 | Williams | |
| 2,660,554 | A | * | 11/1953 | Ostrow | C25D 3/62 205/247 |
| 2,724,687 | A | | 11/1955 | Spreter et al. | |
| 2,976,180 | A | | 3/1961 | Brookshire | |
| 3,475,292 | A | | 10/1969 | Shoushanian | |
| 3,642,589 | A | * | 2/1972 | Nobel | C25D 3/62 205/242 |
| 3,666,640 | A | | 5/1972 | Smith | |
| 3,749,650 | A | * | 7/1973 | Dettke | C25D 3/62 204/DIG. 9 |
| 3,878,066 | A | * | 4/1975 | Dettke | C25D 3/62 205/240 |
| 4,168,214 | A | | 9/1979 | Fletcher | |
| 4,192,723 | A | | 3/1980 | Laude | |
| 4,358,351 | A | | 11/1982 | Simon et al. | |
| 4,591,415 | A | | 5/1986 | Whitlaw | |
| 4,626,324 | A | * | 12/1986 | Samuels | C25D 3/56 205/125 |
| 4,687,557 | A | | 8/1987 | Emmenegger | |
| 4,980,035 | A | * | 12/1990 | Emmenegger | C25D 3/62 205/238 |
| 5,006,208 | A | | 4/1991 | Kuhn et al. | |
| 5,085,744 | A | | 2/1992 | Brasch | |
| 5,169,514 | A | | 12/1992 | Hendriks et al. | |
| 5,244,593 | A | | 9/1993 | Roselle et al. | |
| 5,256,275 | A | | 10/1993 | Brasch | |
| 5,340,529 | A | | 8/1994 | DeWitt et al. | |
| 6,165,342 | A | * | 12/2000 | Kuhn et al. | 205/247 |
| 6,576,114 | B1 | | 6/2003 | Gioria | |
| 6,814,850 | B1 | | 11/2004 | Manz et al. | |
| 2004/0079449 | A1 | | 4/2004 | Kanekiyo et al. | |
| 2004/0195107 | A1 | | 10/2004 | Chalumeau et al. | |
| 2006/0011471 | A1 | | 1/2006 | Grippo | |
| 2006/0254924 | A1 | | 11/2006 | Ichihara et al. | |
| 2006/0283714 | A1 | * | 12/2006 | Egli | C25D 3/58 205/242 |

FOREIGN PATENT DOCUMENTS

| | | | |
|---|---|---|---|
| CH | 390 024 | | 7/1965 |
| CH | 445 434 | A | 7/1968 |
| CH | 555 412 | | 10/1974 |
| CH | 680927 | A5 | 12/1992 |
| CH | 682823 | A5 | 11/1993 |
| DE | 1 696 087 | A | 1/1972 |
| DE | 2829979 | C3 | 6/1990 |

(Continued)

OTHER PUBLICATIONS

Office Action issued in co-pending related U.S. Appl. No. 12/678,984 on Apr. 29, 2015.
Paul A. Kohl, Electrodeposition of Gold, Modern Electroplating 115-130 (Mordechay Schlesinger and Milan Paunovie, eds., 5th ed. 2010).
C.Y. Ho et al., Electrical Resistivity of Ten Selected Binary Alloy Systems, 12 J. Phys. Chem. Ref. Data 183-322 (1983).
Machine translation of WO2009/037180 A1, Dec. 21, 2012, pp. 1-4 (illegible copy received from USPTO) and legible copy of the same produced Jul. 11, 2013, pp. 1-5.
European Search Report issued in corresponding application No. EP09173198, completed Mar. 29, 2010.
Database WPI Thomson Scientific, London, GB; AN 1987-240265 XP002574602 & JP 62 164890 A (Seiko Instr & Electronics Jul. 21, 1987).
Weisberg, Alfred, Gold Plating; Metal Finishing, Elsevier Science and Technology, Jan. 2000, vol. 98, Issue 1.
Machine translation of EP 0480876, downloaded Jun. 13, 2011.
Espacenet—Biblographic data corresponding to EP 0 480 876 A2, last updated Mar. 13, 2013, filed as "Exhibit A" in a co-pending related application.

(Continued)

*Primary Examiner* — Edna Wong
(74) *Attorney, Agent, or Firm* — Oblon, McClelland, Maier & Neustadt, L.L.P.

(57) ABSTRACT

The invention relates to a make-up solution for a galvanic bath comprising organometallic components, a wetting agent, a complexing agent and free cyanide, wherein the make-up solution further comprises copper in the form of copper II cyanide and potassium, and complex indium allowing, after addition of alkaline aurocyanide, to galvanically depositing a gold alloy.

16 Claims, No Drawings

(56) References Cited

FOREIGN PATENT DOCUMENTS

| | | | |
|---|---|---|---|
| EP | 0 193 848 | A1 | 2/1986 |
| EP | 0 384 679 | A | 6/1990 |
| EP | 0 416 342 | A1 | 3/1991 |
| EP | 0 480 876 | A2 | 4/1992 |
| EP | 0 566 054 | A1 | 10/1993 |
| EP | 1 728 898 | A2 | 12/2006 |
| FR | 2 405 312 | A | 5/1979 |
| GB | 1 134 615 | A | 11/1968 |
| GB | 1 156 186 | A | 6/1969 |
| GB | 1 294 601 | A | 11/1972 |
| GB | 1 400 492 | | 7/1975 |
| IN | 2005CH01186 | A | 7/2007 |
| JP | 62-164890 | A | 7/1987 |
| JP | 01-247540 | A | 10/1989 |
| JP | 2005-214903 | A | 8/2005 |
| WO | 97/17482 | A1 | 5/1997 |
| WO | 2009/037180 | A1 | 3/2009 |

OTHER PUBLICATIONS

"Casting and Solidification Process" (Jan. 9, 2010), available at http://www.scribd.com/doc/8288815615-Solidification-Lab.pdf (last visited Jul. 2, 2013).

"Gold Education, Gold Karat Chart, Care of Gold Jewelry," at http://www.netcarats.com/eductation/gold-education.html (downloaded Jul. 4, 2013).

"Finishing Techniques in Metalwork," at http://www.philamuseum.org/booklets/&_42_74_1.html (2013)(downloaded Jul. 6, 2013).

"Carats v. Karats," at http://dendritics.com/scales/carat-def.asp (2013)(downloaded Jul. 5, 2013).

Peter Krauth, "Seven Ways to Tell if Your Gold is Counterfeit," at http://moneymorning.com/2013/02/seven-ways-to-tell-if-your-gold-is-counterfeit/ (Jan. 2, 2013).

Office Action issued in co-pending related U.S. Appl. No. 12/905,788 on Dec. 10, 2013.

CAPLUS abstract (Aug. 7, 2007) corresponding to Indian Patent Application No. 1186/CHE/2005, labeled as "Exhibit A".

Document obtained from Molecular Connections Pvt., Ltd. (2012), which Applicants reasonably believe is a text from Indian Patent Application No. 1186/CHE/2005, labeled as "Exhibit B".

"Gold and Gold Alloys," at http://www. keytometals.com/Print.aspx?id=CheckArticle&site=ktn&LN=EN&NM=230 (Nov. 2009).

Vianco, P. et al., "Interface reactions between 50In-50Pb solder and electroplated Au layers", Materials Science and Engineering A 409, 179-194,2005.

Sukhanov, V. D. et al., "Features of the Domain Structure of Cu3Au—In(Al) Alloys in Thin Films", UDC 669.21 '3: 620.187.3, p. 1-8. 1994.

Shashkov, O. D. et al., "Precipitant Phase Initiation on Periodic Antiphase Domain Boundaries", Metal Physics and Metal Science, vol. 41 No. 6, p. 1-12, UDX 539.4: 548.313.3. 1975.

"Colours of gold alloys—Definition, range of colours and designation", International Organization for Standardization, First Edition, 1987.

Green et al., "A Novel Process for Low-Carat Gold Electroplating Without Cadmium", Oberflaeche-Surface (no month, 1990), vol. 31, No. 10, pp. 11-13.

Office Action issued in co-pending related U.S. Appl. No. 12/678,984 on May 28, 2014.

Anselm T. Kuhn & Leslie V. Lewis, The Electroforming of Gold and Its Alloys, 21 Gold Bulletin 17, 17 (1988, issue 1), available at http://link.springer.com/article/10.1007/BF03214663.

* cited by examiner

METHOD OF OBTAINING A YELLOW GOLD ALLOY DEPOSITION BY GALVANOPLASTY WITHOUT USING TOXIC METALS OR METALLOIDS

This is a Divisional Patent Application of U.S. patent application Ser. No. 12/678,984 filed on Mar. 18, 2010, which is a National Phase Application in the United States of International Patent Application PCT/EP 2008/062042 filed Sep. 11, 2008, which claims priority on Swiss Patent Application No. 01494/07 of Sep. 21, 2007. The entire disclosures of the above patent applications are hereby incorporated by reference.

The invention relates to an electrolytic deposition in the form of a thick gold alloy layer and the manufacturing method thereof In the field of decorative plating, methods are known for producing gold electrolytic depositions that are yellow with a fineness greater than or equal to 9 carats, ductile with a thickness of 10 microns, and with a high level of tarnish resistance. These depositions are obtained by electrolysis in an alkaline galvanic bath containing 0.1 to 3 g/l of cadmium, in addition to gold and copper. The depositions obtained via these known methods have however cadmium levels of between 1 and 10%. Cadmium facilitates the deposition of thick layers, i.e. between 1 and 800 microns and provides a yellow alloy by reducing the quantity of copper contained in the alloy, however, cadmium is extremely toxic and prohibited in some countries.

Other known yellow depositions are alloys comprising gold and silver.

18 carat gold alloys containing copper and zinc and no cadmium are also known. However, these depositions are too pink (fineness too copper rich). Finally, these depositions have poor resistance to corrosion which means that they tarnish quickly.

It is an object of this invention to overcome all or part of the aforementioned drawbacks by proposing a method for depositing a thick gold alloy layer that is yellow and has neither zinc nor cadmium as main components.

The invention thus relates to an electrolytic deposition in the form of a gold alloy, whose thickness is comprised between 1 and 800 microns and includes copper, characterized in that it includes indium as the third main component.

According to other advantageous features of the invention:

- the deposition is substantially free of toxic metals or metalloids;
- the deposition includes a colour comprised within the fields of 1N and 3N (in accordance with ISO standard 8654);
- the deposition is shiny and is highly resistant to corrosion.

The invention also relates to a method for the galvanoplasty deposition of a gold alloy on an electrode dipped in a bath including gold metal in the form of aurocyanide alkaline, organometallic components, a wetting agent, a complexing agent and free cyanide, characterized in that the alloy metals are copper in the form of the copper II cyanide and potassium, and indium in complex aminocarboxylic or aminophosphoric form for depositing a yellow gold alloy.

According to other advantageous features of the invention:

- the bath includes from 1 to 10 $g \cdot l^{-1}$ of gold metal in the form of alkaline aurocyanide;
- the bath includes from 30 to 80 $g \cdot l^{-1}$ of alkaline copper II cyanide;

- the bath includes from 10 $mg \cdot l^{-1}$ to 5 $g \cdot l^{-1}$ indium metal in complex form;
- the bath includes 15 to 35 $g \cdot l^{-1}$ of free cyanide;
- the wetting agent in the bath includes a concentration of between 0.05 to 10 $ml \cdot l^{-1}$;
- the wetting agent is selected from among polyoxyalkylenic, ether phosphate, lauryl sulphate, dimethyldodecylamine-N-oxide, dimethyl-dodecyl ammonium propane sulfonate types or any other type able to wet in an alkaline cyanide medium;
- the aminocarboxylic complexing agent includes a concentration of between 0.1 and 20 $g \cdot l^{-1}$;
- the bath includes an amine in a concentration of between 0.01 and 5 $ml \cdot l^{-1}$;
- the bath includes a depolarising agent in a concentration of between 0.1 $mg \cdot l^{-1}$ and 20 $mg \cdot l^{-1}$;
- the bath includes conductive salts of the following types: phosphates, carbonates, citrates, sulphates, tartrates, gluconates and/or phosphonates;
- the temperature of the bath is maintained between 50 and 80° C.;
- the pH of the bath is maintained between 8 and 12;
- the method is carried out at current densities of between 0.2 and 1.5 $A \cdot dm^{-2}$.

The electrolysis is preferably followed by a thermal treatment at at least 450 degrees Celsius for at least 30 minutes in order to obtain optimum deposition quality.

The bath may also contain a brightener. The brightener is preferably a butynediol derivative, a pyridinio-propane sulfonate or a mixture of the two, a tin salt, sulfonated castor oil, methylimidazole, dithiocarboxylic acid, such as thiourea, thiobarbituric acid, imidazolidinthione or thiomalic acid.

In an example deposition, there is a gold alloy, free of toxic metals or metalloids, in particular free of cadmium, with a 2N yellow colour, a thickness of 200 microns, excellent brilliance and highly wear and tarnish resistant.

This deposition is obtained by electrolysis in an electrolytic bath of the following type:

Example 1

Au: 3 $g \cdot l^{-1}$
Cu: 45 $g \cdot l^{-1}$
In: 0.1 $g \cdot l^{-1}$
KCN: 22 $g \cdot l^{-1}$
pH: 10.5
Temperature: 65° C.
Current density: 0.5 $A \cdot dm^{-2}$
Wetting agent: 0.05 $ml \cdot l^{-1}$ NN-Dimethyldodecyl N Oxide
Iminodiacetic: 20 $g \cdot l^{-1}$
Ethylenediamine: 0.5 $ml \cdot l^{-1}$
Potassium selenocyanate: 1 $mg \cdot l^{-1}$ Example 2

Au: 6 $g \cdot l^{-1}$
Cu: 60 $g \cdot l^{-1}$
In: 2 $g \cdot l^{-1}$
KCN: 30 $g \cdot l^{-1}$
NTA: 4 $g \cdot l^{-1}$
Ag: 10 $mg \cdot l^{-1}$
Diethylentriamine: 0.2 $ml \cdot l^{-1}$
Gallium, selenium or tellurium: 5 $mg \cdot l^{-1}$
Sodium hypophosphite: 0.1 $g \cdot l^{-1}$
Thiomalic acid: 50 $mg \cdot l^{-1}$
Current density: 0.5 $A \cdot dm^{-2}$ Temperature: 70° C.

pH: 10.5

Wetting agent: 2 $ml \cdot l^{-1}$ ether phosphate

In these examples, the electrolytic bath is contained in a polypropylene or PVC bath holder with heat insulation. The bath is heated using quartz, PTFE, porcelain or stabilised stainless steel thermo-plungers. Proper cathodic agitation and electrolyte flow must be maintained. The anodes are made of platinum plated titanium, stainless steel, ruthenium, iridium or alloys thereof Under such conditions, cathodic efficiency of 62 $mg \cdot A \cdot min^{-1}$ can be obtained, with a deposition speed of 1 μm in 3 minutes in example 1 and, in example 2, a shiny deposition of 10 μm in 30 minutes.

Of course, this invention is not limited to the illustrated example, but is capable of various variants and alterations which will be clear to those skilled in the art. In particular, the bath may contain negligible quantities of the following metals: Ag, Cd, Zr, Se, Te, Sb, Sn, Ga, As, Sr, Be, Bi.

Moreover, the wetting agent may be of any type able to wet in an alkaline cyanide medium.

The invention claimed is:

1. A galvanic bath, comprising:

gold metal in the form of alkaline aurocyanide;

organometallic components;

a wetting agent;

a complexing agent;

free cyanide;

copper metal in the form of copper II cyanide and potassium; and indium metal in the form of a complex indium metal, wherein the galvanic bath may optionally comprise silver only in negligible quantity, wherein the galvanic bath does not comprise cadmium, arsenic and zinc, and wherein the galvanic bath deposits a yellow gold alloy.

2. The galvanic bath according to claim 1, wherein the complex indium metal comprises an aminocarboxylic group or an aminophosphonic group.

3. The galvanic bath according to claim 2, wherein the aminocarboxylic group, in complex form, is present in the galvanic bath at a concentration of between 0.1 $g \cdot l^{-1}$ to 20 $g \cdot l^{-1}$.

4. The galvanic bath according to claim 1, wherein the galvanic bath comprises from 30 to 80 $g \cdot l^{-1}$ of copper metal in the form of the copper II cyanide and potassium.

5. The galvanic bath according to claim 1, wherein the galvanic bath comprises from 10 $mg \cdot l^{-1}$ to 5 $g \cdot l^{-1}$ of the complex indium metal.

6. The galvanic bath according to claim 1, wherein the galvanic bath comprises from 15 to 35 $g \cdot l^{-1}$ of the free cyanide.

7. The galvanic bath according to claim 1, wherein the wetting agent is present in the galvanic bath at a concentration of between 0.05 to 10 $ml \cdot l^{-1}$.

8. The galvanic bath according to claim 7, wherein the wetting agent is selected from the group consisting of: polyoxyalkylenic, ether phosphate, lauryl sulphate, dimethyldodecylamine N oxide and dimethyldodecyl ammonium propane sulfonate.

9. The galvanic bath according to claim 1, wherein the galvanic bath further comprises an amine concentration of between 0.01and 5 $ml \cdot l^{-1}$.

10. The galvanic bath according to claim 1, wherein the galvanic bath further comprises a depolarising agent in a concentration of between 0.1 $mg \cdot l^{-1}$ to 20 $mg \cdot l^{-1}$ .

11. The galvanic bath according to claim 1, wherein the galvanic bath further comprises conductive salts selected from the group consisting of: phosphates, carbonates, citrates, sulphates, tartrates, gluconates and phosphonates.

12. The galvanic bath according to claim 1, wherein the galvanic bath comprises from 1 to 10 $g \cdot l^{-1}$ of the gold metal in the form of alkaline aurocyanide.

13. The galvanic bath according to claim 1, wherein the galvanic bath further comprises an additional metal selected from the group consisting of: Zr, Se, Te, Sb, Sn, Ga, Sr, Be and Bi, wherein the individual weight concentrations of gold, copper and indium in the galvanic bath are each greater than the weight concentration of the additional metal.

14. The galvanic bath according to claim 1, wherein a concentration of silver metal in the galvanic bath is 10 $mg \cdot l^{-1}$.

15. The galvanic bath according to claim 1, wherein the galvanic bath does not comprise silver.

16. A galvanic bath, consisting of:

gold metal in the form of alkaline aurocyanide;

organometallic components;

a wetting agent;

a complexing agent;

free cyanide;

copper metal in the form of copper II cyanide and potassium;

indium metal in the form of a complex indium metal;

optionally an amine concentration of between 0.01 and 5 $ml \cdot l^{-1}$;

optionally a depolarising agent in a concentration of between 0.1 $mg \cdot l^{-1}$ to 20 $mg \cdot l^{-1}$; and optionally conductive salts selected from the group consisting of: phosphates, carbonates, citrates, sulphates, tartrates, gluconates and phosphonates, wherein the galvanic bath deposits a yellow gold alloy.

* * * * *